United States Patent [19]

Kimura et al.

[11] Patent Number: 4,707,185

[45] Date of Patent: Nov. 17, 1987

[54] METHOD OF TREATING THE SLAG FROM A COPPER CONVERTER

[75] Inventors: Takayoshi Kimura; Seiichi Tsuyuguchi; Yoshiaka Mori, all of Niihama, Japan

[73] Assignee: Sumitomo Metal Mining Company Limited, Tokyo, Japan

[21] Appl. No.: 823,631

[22] Filed: Jan. 29, 1986

[30] Foreign Application Priority Data

Jan. 31, 1985 [JP] Japan ..... 60-17518

[51] Int. Cl.[4] ..... C22B 7/04

[52] U.S. Cl. ..... 75/24; 75/63; 75/73; 75/74

[58] Field of Search ..... 75/24, 63, 72–76

[56] References Cited

U.S. PATENT DOCUMENTS

| | | | |
|---|---|---|---|
| 3,767,383 | 10/1973 | Bell et al. | 75/76 |
| 3,984,235 | 10/1976 | Petersson et al. | 75/3 |
| 4,032,327 | 6/1977 | Donaldson et al. | 75/72 |
| 4,054,446 | 10/1977 | Makipirtti | 75/76 |
| 4,199,352 | 4/1980 | Jaquay | 75/72 |
| 4,252,560 | 2/1981 | Vanjukov et al. | 75/73 |

FOREIGN PATENT DOCUMENTS 1309739 3/1973 United Kingdom ..... 75/72

*Primary Examiner*—Melvyn J. Andrews

*Attorney, Agent, or Firm*—Watson, Cole, Grindle & Watson

[57] ABSTRACT

A method of treating the slag from a copper converter comprises introducing the molten slag from a copper converter into a furnace having tuyeres through which air can be blown into the molten slag, blowing into the slag through the tuyeres at least 6% by weight of pulverized coal with air or oxygen-enriched air having an oxygen content of 21 to 40% by volume to separate molten metallic copper from the slag, the amount of the air having a ratio of 0.3 to 0.7 to theoretical combustion of the coal, adding a source of sulfur to the separated copper to form a molten matte, maintaining the matte at a reduced pressure not exceeding 0.6 mm Hg for at least five minutes in a vacuum refining apparatus to remove impurities from the matte by volatilization, and treating the refined matte in a copper converter used for the treatment of a matte produced by a smelting furnace.

6 Claims, 3 Drawing Figures

METHOD OF TREATING THE SLAG FROM A COPPER CONVERTER

BACKGROUND OF THE INVENTION

1. Field of the Invention

This invention relates to a method of treating the molten slag from a copper converter to recover copper and other valuable materials effectively therefrom.

2. Description of the Prior Art

The slag from a copper converter usually contains as much as 3 to 5% by weight of copper. It cannot, therefore, be thrown away, but must be treated to recover the copper and other metals therefrom. Flotation is the most common method which is used for collecting copper and other metals from the slag. In this method the slag is solidified and pulverized and then concentrates having a high content of copper are separated by flotation and recycled into a smelting furnace. In another method the slag in its molten state is recycled into a reverberatory or electric smelting furnace. There is also known a method which employs a reducing agent to treat the slag. However, since an electric furnace is mainly used for carrying out this method, it is impossible to stir the molten slag sufficiently to recover satisfactorily recover the copper.

The flotation method has a number of drawbacks. It does not effectively utilize the heat of the slag. A large amount of electric power is required for the pulverization of the solidified slag and the separation of copper concentrates by flotation. It is only the matte particles suspended in the slag that can be recovered by this method. It is impossible to recover the majority of copper, lead, zinc, nickel and other valuable metals that are chemically dissolved in the slag, as they are lost to tailings.

The slag contains a large amount of $Fe_3O_4$. Therefore, if the molten slag is recycled into a reverberatory or electric furnace, it is likely to raise the bottom of the furnace and decrease its effective volume.

The method employing a reducing agent requires a long reaction time and is inefficient, as it is impossible to stir the molten slag and the reducing agent effectively. It usually employs a sulfide to form a matte. Some dissolution of the matte constituents into the slag is unavoidable. The shape of the furnace which is used for carrying out this method presents some difficulty in the separation of the metals to be recovered.

SUMMARY OF THE INVENTION

It is an object of this invention to provide an improved method of treating the slag from a copper converter to recover copper and other valuable materials therefrom.

This method is attained by a method which comprises introducing the molten slag from a copper converter into a furnace having tuyeres through which air can be blown into the molten slag, blowing through the tuyeres into the slag at least 6% by weight of pulverized coal with air or oxygen-enriched air having an oxygen content of 21 go 40% by volume to separate molten metallic copper from the slag, the amount of the air having a ratio of 0.3 to 0.7 to the theoretical amount needed for combustion of the coal, adding a source of sulfur to the separated copper to form a molten matte, maintaining the matte at a reduced pressure not exceeding 0.6 mm Hg for at least five minutes in a vacuum refining apparatus to remove impurities from the matte by volatilization, and treating the refined matte in a copper converter provided for the treatment of a matte produced by a smelting furnace.

As the molten slag from a copper converter is subjected to reduction treatment in a furnace having tuyeres, its heat can be utilized for the recovery of the copper. The recovered copper is formed into a matte and the matte is refined by vacuum volatilization and recycled into the converter. This invention enables the production of crude copper containing only a small amount of impurities by eliminating the process of flotation, or without causing any trouble that has hitherto been caused by magnetite if the molten slag is recycled into a smelting furnace.

DETAILED DESCRIPTION OF THE INVENTION

Figure 1:
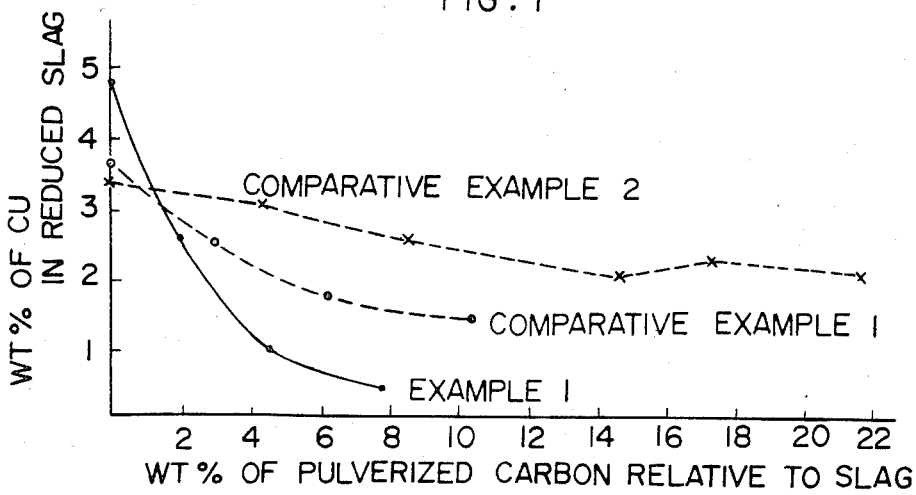
FIG. 1 is a graph showing the amount of copper in a reduced slag in relation to the amount of pulverized coal with the lapse of the lancing time, and showing the results of EXAMPLE 1 and COMPARATIVE EXAMPLES 1 and 2 which will hereinafter be described.

According to this invention, the slag from a copper converter is treated by a nonferrous metal smelting converter, or a fixed hearth furnace provided in the sidewall thereof with a plurality of tuyeres through which air can be blown into the molten slag. If a PS type nonferrous metal smelting converter is used, its tuyeres are immersed in the molten slag and the air supplied therethrough stirs the slag strongly to enable the quick reaction of pulverized coal and the efficient cleaning of the slag. As the converter is tiltable, it is easy to discharge the treated slag therefrom and recover the separated copper therefrom.

The fixed hearth furnace which can be employed in accordance with this invention is, for example, a fuming furnace for separating zinc from the slag of a lead smelting furnace by volatilization. Although this type of furnace has a water cooling jacked on its sidewall and tends to dissipate a large amount of heat, its tuyeres are immersed in the molten slag and the air supplied therethrough stirs the slag strongly to accomplish the efficient cleaning of the slag. As it has a fixed hearth, however, it has the disadvantage of requiring tapping for discharging the treated slag and the separated copper.

It is not recommendable to use a top lancing tube for introducing pulverized coal into the slag, since the top lancing method fails to supply the coal into the bottom of the molten bath and stir it satisfactorily. The use of lump coal or breeze coke as a reducing agent should be avoided, as they have too low an efficiency of reaction to achieve any satisfactory recovery of copper.

The pulverized coal which has been blown into the molten slag with air or oxygen-enriched air reacts with the oxygen in the air to form CO and $CO_2$, as shown below:

$$2C+O_2=2CO \quad (1)$$

$$C+O_2=CO_2 \quad (2)$$

The slag contains about 35% by weight of $Fe_3O_4$. It is reduced mainly by the reaction shown by the following equation:

$$Fe_3O_4+CO=3FeO+CO_2 \quad (3)$$

A part of $Fe_3O_4$ is directly reduced by carbon, as shown below:

$$Fe_3O_4+C=3FeO+CO \quad (4)$$

The decrease of $Fe_3O_4$ by reduction lowers the viscosity of the slag. Therefore, the majority of the copper in the slag, which exists in the form of a matte, is reduced into a metallic form by the oxygen in the air and the pulverized coal. The copper suspended in the slag settles down. Each of the valuable metals M existing mainly in the form of an oxide in the slag is reduced in accordance with the following reaction:

$$M_xO+CO=xM+CO_2 \quad (5)$$

The resulting metals, such as Ni, Co, Sn, As, Sb and Bi, are absorbed into the copper which has settled down. Zinc and lead are partly absorbed into the copper, while the rest thereof is volatilized, oxidized again in waste gas and recovered in the form of dust.

In order to ensure the satisfactory reactions according to equations (3) to (5) to recover copper and other valuable metals from the slag, it is necessary to blow at least 6% by weight of pulverized coal into the slag with air of which the amount has a ratio of 0.3 to 0.7 to theoretical combustion of the coal. If the amount of the coal is less than 6% by weight, it fails to the amount needed for generate a sufficiently large amount of heat to achieve the satisfactory reactions, even if the oxygen content of the air may be increased when an air ratio of 0.3 to 0.7 is maintained. If an air ratio exceeding 0.7 is adopted, the combustion of the pulverized coal proceeds mainly in accordance with equation (2) and fails to produce a sufficiently large amount of CO for the reducing reactions according to equations (3) and (5). If the air ratio is lower than 0.3, the effective generation of heat by the pulverized coal is reduced and the temperature of the molten bath is lowered by the reducing reactions of equations (3) to (5), which are endothermic, the loss of heat to waste gas and the dissipation of heat through the furnace wall. It is difficult to maintain the satisfactory reactions.

In a converter for treating a copper matte, it is usual that the molten bath temperature is maintained only by the exothermic reaction between the constituents of the matte and the oxygen in the air which is blown thereinto. According to this invention, the molten bath temperature is maintained by the oxidizing reaction of the pulverized coal coal and the reactions (3) to (5) are endothermic. The reactions are strong during the beginning of operation when the slag still contains a large amount of $Fe_3O_4$ and $M_xO$ and weak toward the end of operation. Therefore, the bath temperature drops due to the shortage of heat during the beginning of the reaction, while it rises toward the end of the reaction. Therefore, it is advisable to blow air having an oxygen content of 21 to 40% by volume during the first half of the reaction period and air having an oxygen content of 21 to 30% by volume during the second half thereof, though its specific oxygen content depends on the size of the converter or fixed hearth furnace, the amount of the heat thereby dissipated, the temperature of the air and the magnetite and other metal oxide contents of the slag.

The copper which has settled down and the remaining slag are discharged by tilting the converter or tapping the fixed hearth furnace after the supply of the air has been discontinued. The slag is first discharged. It usually contains only up to 0.5% by weight of copper and can be thrown away. If only a small amount of copper has been separated, it need not be discharged each time, but it is practical to wait until a sufficiently large amount of copper is obtained after the reduction treatment of the slag has been repeated.

The copper is, then, placed in a vacuum furnace and while it is kept in its molten state, a source of sulfur is added to it until it forms a matte. The source of sulfur may be elemental sulfur, which can be blown into the furnace with the aid of nitrogen gas, or may alternatively be iron sulfide ore. The source of sulfur is preferably added until the matte has a sulfur content of at least 22% by weight. If the matte has a sulfur content which is lower than 22% by weight, Sn and Sb have an undesirably low rate of volatilization.

The source of sulfur is added after the metallic copper has been separated from the slag, since the copper in its metallic form is very easy to separate from the slag. If the source of sulfur is added during the reduction of the slag, the matte forms some solid solution in the slag and the slag which is discharged has an undesirably high copper content. It does, however, present any problem at all to add the source of sulfur before the copper is placed in the vacuum furnace.

The vacuum furnace in which the matte has been placed is evacuated until it has a pressure not exceeding 0.6 mm Hg. The reduced pressure is maintained for at least five minutes so that various metals, such as Zn, Pb, As, Sb and Bi, may be recovered from the molten matte by volatilization. When the matte still contains a large amount of volatile matter, the pressure of the furnace cannot be reduced to a very low level, though it depends on the size and evacuation capacity of the apparatus. If it has been reduced to a level not exceeding 0.6 mm Hg, substantially no further volatilization can be expected. The temperature of the molten matte in the vacuum furnace may be held at or above its melting point by employing, for example, a low frequency induction furnace. No particularly high temperature is required. If the slag does not contain a large amount of As, Sb or Bi, the separated copper does not need to be formed into a matte for the volatilization of the various metals, but can be directly recycled into a furnace for the treatment of a matte produced by a smelting furnace.

The various metals obtained by volatilization in the vacuum furnace, such as Pb, Zn, Sn, As, Sb and Bi, can be recovered by an appropriate dust collector and separated from one another by wet treatment or otherwise.

The matte refined by the substantial removal of the impurities by volatilization in the vacuum furnace is recycled into an ordinary converter which is used for the treatment of a matte produced by a smelting furnace. Thus, the majority of the copper which the slag contains can be placed in an electrolytic refining process. The timing for recycling the matte into the converter depends on the source of sulfur which has been used. If elemental sulfur has been used, the matte can be recycled into the converter during the period of blister making without presenting any possibility of the nickel or cobalt which it contains being lost into the slag. If iron sulfide ore has been used, it is necessary to recycle the matte during the period of slag forming, as it contains iron.

The invention will now be described with reference to a number of examples.

EXAMPLE 1

A PS converter lined with a brick wall having an inside diameter of 1.5 m and an inside length of 1.7 m and provided with four tuyeres having an inside diameter of 21 mm was charged with 3020 kg of a molten converter slag of the composition shown in TABLE 1. Pulverized coal was blown into the slag through the tuyeres at a rate of 4.9 kg/min. with air at a rate of 11.6 $Nm^3$/min. and 95% purity oxygen at a rate of 0.54 $Nm^3$/min. for a period of 47 minutes. The total amount of the pulverized coal was 7.6% by weight of the slag. The amount of the air had an average ratio of 0.4 to theoretical combustion of the coal. The air had an oxygen content of 24.3% by volume. There were recovered 182.5 kg of copper with 80 kg of dust and 2675 kg of reduced slag. The analysis of each of them is shown in TABLE 1.

FIG. 1 shows the percentage of copper in the reduced slag in relation to the amount of pulverized coal relative to the slag treated during the reduction process, or the blowing time. The percentage by weight of copper in the slag dropped with the lapse of time. When the amount of the carbon exceeded 6% by weight of the slag, the amount of copper dropped below 0.5% by weight and the slag could be thrown away.

TABLE 1

(wt. %)

| | Cu | Pb | Zn | Ni | Co | Sn |
|---|---|---|---|---|---|---|
| Slag | 4.89 | 1.04 | 2.50 | 0.20 | 0.38 | 0.22 |
| Recovered Copper | 73.6 | 7.74 | 2.07 | 3.14 | 2.52 | 3.27 |
| Dust | 3.66 | 18.1 | 28.3 | <0.01 | <0.01 | 0.33 |
| Reduced slag | 0.40 | 0.11 | 1.58 | 0.01 | 0.26 | 0.01 |
| | As | Sb | Bi | Fe | S | $Fe_3O_4$ |
| Slag | 0.09 | 0.16 | 0.002 | 45.1 | 1.0 | 35 |
| Recovered copper | 1.24 | 1.98 | 0.02 | 1.0 | 1.0 | — |
| Dust | 0.31 | 0.06 | 0.025 | 3.8 | 3.0 | — |
| Reduced slag | 0.01 | 0.04 | <0.001 | 50.6 | 0.2 | <2 |

COMPARATIVE EXAMPLE 1

The tuyeres of the converter used in EXAMPLE 1 were closed and it was charged with 4230 kg of a converter slag containing 3.62% by weight of copper. A lancing tube having an inside diameter of 40 mm was inserted into the converter through its working mouth until its lower end reached the level of the molten bath which was charged but not blown. Pulverized coal was blown at a rate of 8.16 kg per minite with air at a rate of 23.2 $Nm^3$/min. for 54 minutes. The amount of the air had a ratio of 0.4 to theoretical combustion of the coal. The amount of the carbon was 10.4% by weight of the slag. The slag could not be reduced satisfactorily, but still contained 1.30% by weight of copper. The percentage by weight of copper in the reduced slag is shown in FIG. 1 in relation to the blowing time.

COMPARATIVE EXAMPLE 2

The converter used in EXAMPLE 1 was charged with 4060 kg of a converter slag containing 3.38% by weight of copper. Lump coal having a diameter of 25 to 50 mm was supplied at a rate of 4.42 kg/min., and air at a rate of 16.84 $Nm^3$/min. through the tuyeres for 190 minutes. The amount of the air had a ratio of 0.54 to theoretical combustion of the coal. The amount of the coal was 20.7% by weight of the slag. The slag could not be reduced satisfactorily, but still contained 2.07% by weight of copper. See FIG. 1, too, for the percentage by weight of copper in the reduced slag in relation to the blowing time.

EXAMPLE 2

Figure 2:
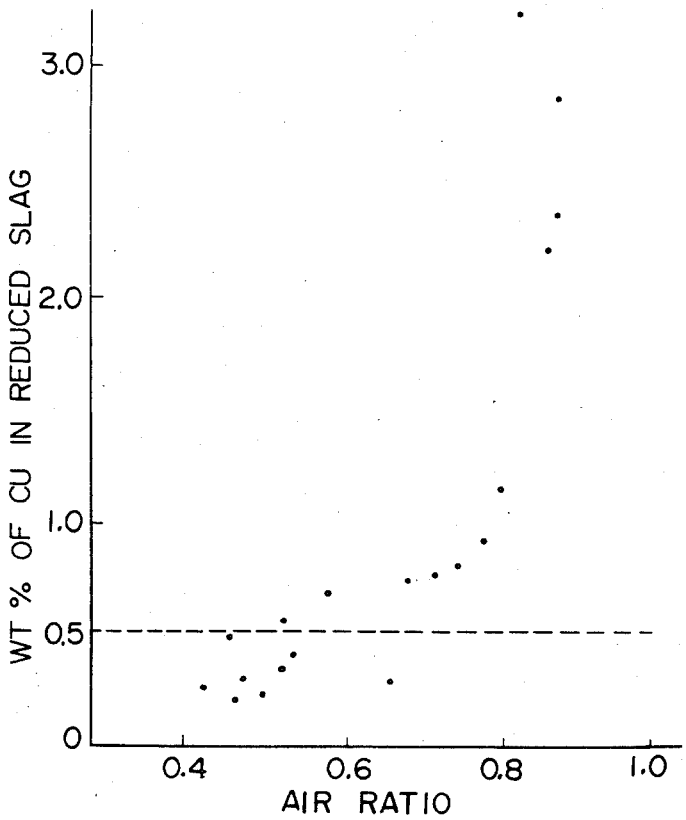
FIG. 2 is a graph showing the amount of copper in the reduced slag obtained in EXAMPLE 2 in relation to the ratio of the air employed
Figure 3:
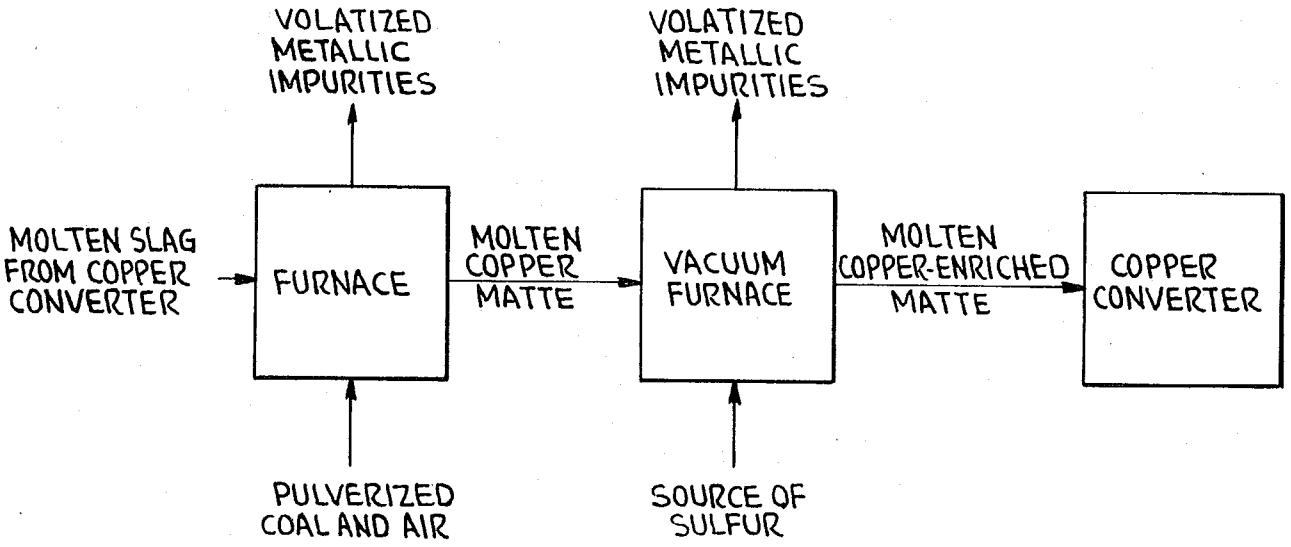
FIG. 3 is a block diagram illustrating the basic steps of the inventive method.

The converter used in EXAMPLE 1 was charged with 3000 to 3300 Kg of a converter slag containing 4.7 to 4.8% by weight of copper. Pulverized coal was blown into the amount of 6 to 18% by weight of the slag with oxygen-enriched air of which the amount had an air ratio of about 0.4 to 0.8. The blowing time was from 30 to 150 minutes. FIG. 2 shows the percentage by weight of copper in the reduced slag in relation to the air ratio. As is obvious therefrom, the use of an air ratio exceeding 0.7 gave rise to a sharp increase in the percentage of copper in the reduced slag.

EXAMPLE 3

The copper obtained by the reduction of a converter slag was converted to a matte and impurities were removed therefrom by volatilization in a vacuum refining apparatus.

The recovered copper contained 84.1% Cu, 3.92% Pb, 1.0% Zn, 0.96% Sn, 1.40% As, 1.51% Sb, 0.03% Bi, 1.40% Ni, 1.04% Co, 3.4% Fe and 0.26% S, all by weight. After elemental sulfur had been added, the copper was held at a temperature of 1200° C. to form a matte having a sulfur content of 22.4% by weight and a matte having a sulfur content of 11.2% by weight. The copper was recovered and the mattes were each placed in a tammann tube having an inside diameter of 30 mm and a height of 150 mm. It was placed in a high frequency vacuum melting furnace and after the furnace had been purged with a neutral gas, it was heated to each temperature shown in TABLE 2 in about half an hour. It was evacuated by a vacuum pump to suck the products of volatilization and a reduced pressure of 0.04 to 0.6 mm Hg was maintained for a period of five to 15 minutes, whereby the impurities were removed. The composition of each refined product is shown in TABLE 2.

TABLE 2

| Run No. | Wt. % of S in material | Temp. °C. | Reduced pres., mmHg | Its duration, min. | Phase |
|---|---|---|---|---|---|
| 1 | 0.26 | 1200 | 0.04 | 10 | Metal |
| 2 | 22.4 | 1230 | 0.6 | 5 | Matte |
| 3 | 22.4 | 1230 | 0.2 | 15 | " |
| 4 | 22.4 | 1150 | 0.2 | 15 | " |
| 5 | 11.2 | 1230 | 0.2 | 15 | Metal Matte |

| Run | Metal or matte composition (wt. %) | | | | | | | |
|---|---|---|---|---|---|---|---|---|
| No. | Cu | Pb | Zn | Sn | As | Sb | Bi | Ni |
| 1 | 87.2 | 0.09 | 0.01 | 1.0 | 1.36 | 1.58 | <0.01 | 1.60 |
| 2 | 69.6 | 0.24 | 0.06 | 0.02 | <0.01 | 0.34 | " | 1.26 |
| 3 | 71.0 | 0.27 | 0.08 | " | " | 0.28 | " | 1.28 |
| 4 | 69.1 | 0.53 | 0.11 | 0.05 | 0.01 | 0.38 | " | 1.31 |
| 5 | 85.7 | 1.78 | 0.04 | 1.74 | 0.08 | 2.76 | 0.02 | 2.46 |
| | 71.3 | 0.63 | 0.07 | 0.05 | <0.01 | 0.22 | 0.01 | 0.69 |

| Run | Metal or matte composition (wt. %) | | |
|---|---|---|---|
| No. | Co | Fe | S |
| 1 | 1.38 | 4.44 | 0.40 |

TABLE 2-continued

| | | | |
|---|---|---|---|
| 2 | " | 4.40 | 21.7 |
| 3 | " | 4.34 | 21.3 |
| 4 | 1.37 | 4.58 | 21.6 |
| 5 | 1.80 | 1.21 | 1.4 |
| | 1.20 | 5.69 | 19.1 |

In Run No. 1, no sulfur was added, but the metal was refined at a reduced pressure. Virtually no Sn, As or Sb could be removed, though Pb and Zn were removed. Runs Nos. 2 to 4 represent this invention. Not only Pb and Zn, but also Sn, As and Sb could be satisfactorily removed by volatilization, despite the use of different conditions. In Run No. 5, no sufficient sulfur for matte formation was added prior to vacuum refining. Both of the metal and matte phases were produced. Virtually no Sn or Sb volatilized, but the majority of As did.

These results teach that in order to remove the impurities by volatilization from the copper recovered by the reduction of a converter slag, it is effective to add sulfur to it until it completely forms a matte.

What is claimed is:

1. A method of concentration copper and recovering metallic impurities from a molten slag from a copper converter which includes copper and metallic impurities, said metallic impurities including lead, zinc, nickel, cobalt, tin, bismuth, arsenic and antimony, said method comprising the steps of:

(a) introducing said molten slag into a furnace having tuyeres through which pulverized coal and air can be blown into said molten slag below its surface;

(b) blowing at least 6% by weight of pulverized coal, based on the weight of the slag, together with air or oxygen-enriched air having an oxygen content of 21 to 40% by volume through said tuyeres and into said molten slag such that molten metallic copper will precipitate from the slag, said molten metallic copper absorbing most of said metallic impurities as its precipitates, the amount of said air blown into said slag being 0.3 to 0.7 of the theoretical amount needed for complete combustion of said pulverized coal;

(c) adding a source of sulfur to said precipitated molten metallic copper to form a molten matte having said metallic impurities therein;

(d) subjecting said molten matte to a reduced pressure of up to and including 0.6 mm Hg for at least five minutes in a vacuum refining apparatus to volatilize most of said metallic impurities from said molten matte, leaving a copper-enriched matte;

(e) recovering said volatized metallic impurities; and (f) conveying said copper-enriched matte into a copper converter.

2. A method as set forth in claim 1, wherein in step (b) said oxygen content of 21 to 40% by volume is employed during the first half of a reaction period and changed to a range of 21 to 30% by volume during the second half thereof.

3. A method as set forth in claim 1, wherein said source of sulfur is added in step (c) until said molten matte has a sulfur content of at least 22% by weight.

4. A method as set forth in claim 1, wherein said source of sulfur in step (c) is elemental sulfur, and wherein said elemental sulfur is blown into said metallic copper with nitrogen gas.

5. A method as set forth in claim 1, wherein said source of sulfur in step (c) is iron sulfide ore.

6. A method as set forth in claim 1, wherein said copper-enriched matte in step (d) is maintained at a temperature which is at least equal to its melting point.

* * * * *